United States Patent [19]

Daniels

[11] 4,392,318

[45] Jul. 12, 1983

[54] SAFETY STRAP FOR HANDGUNS

[76] Inventor: William J. Daniels, 3229 Wallace, Kansas City, Mo. 64129

[21] Appl. No.: 302,363

[22] Filed: Sep. 15, 1981

[51] Int. Cl.[3] ..... F41C 27/00

[52] U.S. Cl. ..... 42/1 LP

[58] Field of Search ..... 42/1 LP, 1 Y, 1 N, 70 R, 42/70 F

[56] References Cited

U.S. PATENT DOCUMENTS 835,349 11/1906 Deming ..... 42/1 LP

*Primary Examiner*—Charles T. Jordan

*Attorney, Agent, or Firm*—Kokjer, Kircher, Bradley, Wharton, Bowman & Johnson

[57] ABSTRACT

A safety strap which maintains the hammer of a handgun in a cocked position. The strap can be drawn around the gun body and includes snap fasteners on its opposite ends. An opening formed in an enlarged intermediate portion of the strap fits over the hammer to prevent it from firing. The strap includes an additional pair of openings on opposite sides of the central opening for holding the safety on regardless of whether the safety is located on one side of the gun body or the other.

10 Claims, 3 Drawing Figures

SAFETY STRAP FOR HANDGUNS

BACKGROUND AND SUMMARY OF THE INVENTION

This invention relates generally to safety devices for firearms and more particularly to a safety strap which can be applied to a handgun to maintain the hammer in a cocked position.

Although single action semi-automatic handguns have a number of appealing features, the need to manually cock the hammer in order to prepare the weapon for use has detracted somewhat from the acceptance of this type of handgun. For example, persons who are unfamiliar with guns or who have difficulty in manually cocking the hammer are deterred from using the gun. In addition, the time consumed in cocking the weapon can cause a delay in firing that may have serious adverse consequences. While it is possible to cock the hammer in advance and store the gun with the hammer in a cocked position, the weapon is then fully prepared to be fired and can be accidentially discharged relatively easily. As a consequence, some persons are uncomfortable with the lack of safety resulting when the gun is stored with the hammer cocked.

To my knowledge, there have been no safety devices available in the past which lessen or eliminate the safety problems associated with storing a pistol in the cocked and ready to fire condition. All of the known safety devices are intended for use with other types of weapons and function to prevent pulling of the trigger or cocking of the hammer. For example, the strap arrangement shown in U.S. Pat. No. 835,349 to Deming is designed for use with a rifle and includes a rigid keeper element that acts to prevent cocking of the hammer rather than maintaining the hammer in the cocked position. All of the other devices known to me are in the form of trigger locks and similar rigid devices have a number of obvious drawbacks making them unsuitable in many circumstances.

The present invention has, as its principal goal, the provision of a safety device that permits single action semi-automatic handguns to be safely kept in the cocked position ready for use.

More specifically, it is an object of the invention provide a safety strap that can be applied to a handgun in a manner to maintain the hammer cocked to prevent the gun from firing until the strap is removed.

Another important object of the invention is to provide a safety strap that can be quickly and easily applied to the gun and, more importantly, quickly and easily released when the gun is needed. The strap can be removed simply by disconnecting the snap fasteners which hold it in place on the gun body.

Yet another object of the invention is to provide a safety strap of the character described that also maintains the safety of the gun on when the strap is applied to the gun. Further in this respect, the strap is constructed to accommodate a safety located on either side of the gun, and its effectiveness in preventing accidental discharge is increased accordingly.

An additional object of the invention is to provide a safety strap of the character described that is suited for use with guns that vary widely in size, style and construction. The strap can, with only minor variations, be adapted for use with handguns produced by virtually all manufacturers.

A still further object of the invention is to provide a safety strap of the character described that is durable, lightweight, and simple and economical to construct.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 2:
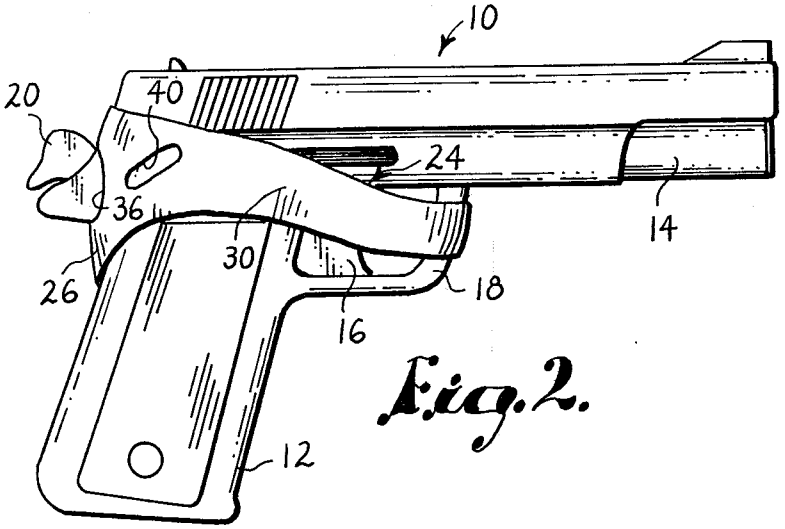
FIG. 2 is a side elevational view similar to FIG. 1 but taken from the opposite side of the gun.

Referring now to the drawing in more detail, numeral 10 generally designates a typical single action semi-automatic handgun of the type to which the safety strap of the present invention may be applied. The body of handgun 10 includes a handle 12, a barrel 14 extending from the top of the handle, a trigger 16 and a trigger guard 18 located on the front of the handle and below the barrel portion of the gun. The handgun 10 is a single action weapon which requires that the hammer 20 be manually cocked initially in order to prepare the gun for firing. One side of the gun body has a small safety lever 22 located near the top of the handle. In the position shown, safety lever 22 is on, and the weapon cannot be fired. Release of the safety to the off position permitting firing of the gun requires that it be pivoted downwardly or counter-clockwise as viewed in FIG. 1. The safety lever is located on the left side of the gun body so that it can be taken off by using the thumb of the right hand or by using the left hand when the gun is held in the right hand of the user. It should be noted that the safety can be located on the opposite or right side of the gun for lefthanded persons so that the gun can be held in the left hand and the safety manipulated with the left thumb or the right hand.

In accordance with the present invention, a safety strap 24 can be applied to the handgun to maintain hammer 20 in the cocked position. In a preferred form of the invention, the safety strap 24 is formed of leather and in any event, the strap is flexible so that it can be drawn around the gun body.

Figure 3:
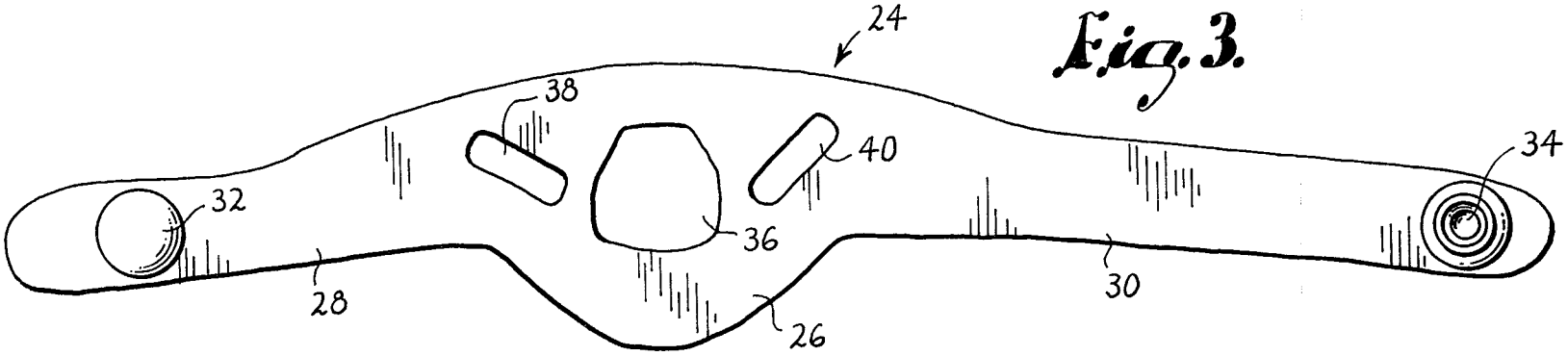
FIG. 3 is an enlarged elevational view of the safety strap detached from the gun.

The exact configuration of strap 24 can vary depending upon the size and style of the gun with which it is used. As shown in FIG. 3, a safety strap suitable for use with the handgun 10 includes an enlarged portion 26 located intermediate the ends of the strap. Strap portions 28 and 30 extend from the central portion 26 in opposite directions and terminate in free opposite ends of the strap. The strap is contoured to conform with the contour of the handle 12 and trigger guard 18. Mating snap fasteners 32 and 34 of conventional construction are secured to the respective strap portions 28 and 30 near the free opposite ends of the strap.

The central portion 26 of the strap is considerably wider than the strap portions 28 and 30. A contoured opening 36 is formed in the enlarged portion 26 approximately centrally thereon. The opening 36 has a size to fit snuggly over the hammer 20 of the weapon. A pair of elongated holes 38 and 40 are formed on opposite sides of the opening 36. The size, location and orientation of opening 38 is such that it fits snuggly over the safety lever 22 when the strap is applied to the gun with the safety in the on position shown in FIG. 1. The other opening 40 engages the opposite side of the gun, and its size and position are such that it fits snuggly over a safety on the right side of the gun body if the gun is constructed for a lefthanded user.

Figure 1:
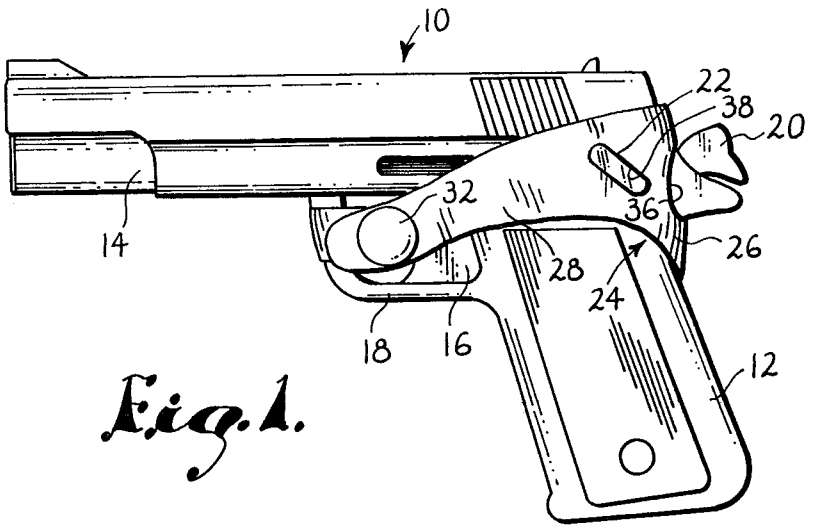
FIG. 1 is a side elevational view showing the safety strap in the present invention applied to a single action automatic handgun in order to maintain the hammer of the gun in a cocked position.

In use, the safety strap 24 permits a single action semi-automatic handgun to be cocked and stored in the cocked and ready to use condition without presenting the safety problems that result when the strap is not used. After the gun has been manually cocked to position hammer 20 as shown in FIGS. 1 and 2, the strap 24 is applied to the gun by fitting opening 36 over the cocked hammer 20 and against the back of the gun. The strap portions 28 and 30 are then drawn tightly around the upper portion of handle 12 and around the front of trigger guard 18 until the free opposite ends of the strap overlap one another. The snap fasteners 32 and 34 can then be snapped together to secure the strap in place on the gun body. The length of the strap is such that it is maintained in a taut condition around the handle and trigger guard of the gun when the snap fasteners are connected.

When the strap is applied to the gun in this manner, the material on the enlarged portion 26 of the strap is positioned between the hammer 20 and the firing pin (not shown). Consequently, even if the trigger 16 is inadvertently pulled, hammer 20 is prevented from firing the gun, and the gun can thus be safely stored with hammer 20 in a cocked position, It is to be noted that the safety strap 24 can be properly applied to the gun only if the safety lever 22 is in the on position shown in FIG. 1. Otherwise, opening 38 will not register with the safety, thus alerting the user to the fact that the safety is not on. When the strap is applied to the gun with the safety on, opening 38 fits snuggly over the safety and prevents it from being pivoted downwardly to the off position. In this manner, the safety strap maintains hammer 20 in the cocked position and the safety 22 in the on position.

To prepare the gun for firing, it is only necessary to remove strap 24 by pulling the strap end carrying fastener 32 away from the other strap end to disconnect the snap fasteners 32 and 34. This can be easily accomplished in a moment, and the gun is then ready to be fired once the safety 22 is released. Due to the ease with which the safety strap can be removed and the small amount of time required to remove it, persons who are lacking in strength or are unfamiliar with guns fined it much easier to remove the strap than to manually cock the hammer 20. Accordingly, the safety strap makes single action semiautomatic pistols suitable for use by such persons without sacrificing safety. Although it is contemplated that the safaety strap will be used principally with single action pistols that must be cocked manually, it is also useful with other types of handguns such as revolvers in which the hammer can be manually cocked if desired.

The provision of two elongated holes 38 and 40 on opposite sides of opening 36 permits strap 24 to be used with guns having the safety on either side and thus increases the versatility of the strap. It may be desirable in some instances to elimate the holes 38 and 40 or to provide indentations or recesses in the inside surface of the strap at the locations of the holes shown in the illustrated form of the invention. One or the other of the recesses would then receive safety 22 to maintain it on until the strap is removed from the gun. As previously indicated, the strap is preferably constructed of leather although other materials are possible. It is preferred that the outside surface of the safety strap be attractively finished in order to enhance the physical appearance of the strap.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A safety strap arrangement for a handgun having a gun body and an exposed hammer that can be cocked to prepare the gun for firing, said safety strap arrangement comprising:

an elongate flexible strap adapted to be drawn around the gun body and having opposite ends positionable adjacent one another when the strap is drawn around the gun body in a taut condition;

means in a selected portion of said strap providing an opening in the strap adapted to fit over the hammer when same is cocked and the strap is applied to the gun and drawn around the gun body, said selected portion of the strap being located between the hammer and gun body to prevent firing of the hammer when said opening is fitted over the hammer; and releasable fastening means for releasably fastening said opposite ends of the strap together to maintain the strap on the gun in a taut condition with said opening of the strap fitted over the hammer, thereby preventing firing of the gun until said fastening means is released and the strap is removed from the gun.

2. The invention of claim 1, wherein said fastening means comprises a first fastening element on one end of the strap and a second fastening element on the opposite end of the strap, said first and second fastening elements being constructed to snap together and to separate upon pulling apart of the ends of the strap.

3. The invention of claim 1, wherein:

said selected portion of the strap comprises an enlarged portion thereof located between said opposite ends and having a greater width than the portions of the strap between said enlarged portion and said ends; and said opening is formed in said enlarged portion of the strap and is sized to fit snuggly over the hammer when same is cocked.

4. The invention of claim 3, wherein the gun has a safety element movable between an on position to prevent firing of the gun and an off position to permit firing of the gun, said enlarged portion of the strap being constructed to engage said safety element in a manner to hold same in the on position when the strap is fastened to the gun.

5. The invention of claim 4, including a second opening in said enlarged portion of the strap located and sized to fit closely on said safety element when same is in the on position and the strap is fastened to the gun with the first mentioned opening fitted over the hammer, whereby said second opening holds the safety element in the on position.

6. The invention of claim 4, including a pair of elongate holes in said enlarged portion of the strap spaced on opposite sides of said opening, said openings being located and sized to fit closely on safety elements located on the opposite sides of the gun body when the strap is fastened to the gun with the safety element in the on position, whereby a safety element located on either side of the gun body is held in the on position by one of said holes.

7. The invention of claim 1, wherein the gun has a safety element movable between an on position to prevent firing of the gun and an off position to permit firing of the gun, said strap having a hole therein spaced from said opening and located and sized to fit closely on the safety element when the strap is fastened on the gun with the safety element in the on position, said hole thereby maintaining the safety element in the on position.

8. The invention of claim 1, including a safety element on one side of the gun body movable between an on position to prevent firing of the gun and an off position to permit firing of the gun, said strap including first and second holes spaced on opposite sides of said opening with said first hole being located and sized to fit on a safety element disposed in the on position on a first side of the gun body and said second hole being located and sized to fit on a safety element disposed in the on position on a second side of the gun body, a safety element on either side of the gun body thereby being held in the on position when the strap is fastened to the gun.

9. The invention of claim 1, wherein the gun body includes a handle below said hammer and a trigger guard in front of said handle, said strap having a length to be tightly drawn around said handle and trigger guard with said opening fitting over the hammer in the cocked position thereof and said ends overlapping adjacent one another for fastening together of the ends.

10. The invention of claim 9, wherein said fastening means comprises a pair of straps fasteners on the overlapping ends of the strap.

* * * * *